US006638617B2

(12) United States Patent
Kim et al.

(10) Patent No.: US 6,638,617 B2
(45) Date of Patent: Oct. 28, 2003

(54) DUAL LAYER INSULATION SYSTEM

(75) Inventors: Young Joon Kim, Greenfield, MA (US); Anthony E. Listro, South Deerfield, MA (US); Akshay H. Trivedi, Greenfield, MA (US)

(73) Assignee: Judd Wire, Inc., Turners Falls, MA (US)

( * ) Notice: Subject to any disclaimer, the term of this patent is extended or adjusted under 35 U.S.C. 154(b) by 0 days.

(21) Appl. No.: 09/992,375

(22) Filed: Nov. 16, 2001

(65) Prior Publication Data

US 2002/0096356 A1 Jul. 25, 2002

Related U.S. Application Data

(60) Provisional application No. 60/253,617, filed on Nov. 28, 2000.

(51) Int. Cl.[7] ..... D02G 3/00; H01B 7/00

(52) U.S. Cl. ..... 428/383; 428/375; 428/379; 174/120 SR; 174/121 A

(58) Field of Search ..... 428/375, 379, 428/383; 174/120 SR, 121 A

(56) References Cited

U.S. PATENT DOCUMENTS

| | | | |
|---|---|---|---|
| 2,317,811 | A | 4/1943 | Scheiber |
| 2,333,922 | A | 11/1943 | Foster |
| 2,480,298 | A | 8/1949 | Happoldt, Jr. |
| 2,581,212 | A | 1/1952 | Spooner, Jr. et al. |
| 3,445,394 | A | 5/1969 | Hunt |
| 3,692,924 | A | 9/1972 | Nye |
| 4,151,366 | A | 4/1979 | Betts et al. |
| 4,456,785 | A | 6/1984 | Kushner et al. |
| 5,236,985 | A | 8/1993 | Hayami |
| 5,358,786 | A | 10/1994 | Ishikawa et al. |
| 5,521,009 | A | 5/1996 | Ishikawa et al. |
| 5,525,757 | A | 6/1996 | O'Brien |
| 5,817,981 | A | 10/1998 | Arroyo |
| 6,239,219 | B1 | 5/2001 | Breant et al. |

FOREIGN PATENT DOCUMENTS

| | | | |
|---|---|---|---|
| JP | 57009003 | A | 1/1982 |

*Primary Examiner*—Cynthia H. Kelly
*Assistant Examiner*—J. M. Gray
(74) *Attorney, Agent, or Firm*—Holland & Bonzagni, P.C.; Mary R. Bonzagni, Esq.

(57) ABSTRACT

A low-smoke, highly flame-retardant and flexible dual layer insulation system, which demonstrates improved cut-through resistance, is provided. The inventive insulation system, which is suitable for use as an outer covering for wires or conductors, comprises a cross-linked, highly flame-retardant and halogen-free first insulating layer and a tough, flexible second insulating layer.

33 Claims, No Drawings

DUAL LAYER INSULATION SYSTEM

This application claims the benefit of provisional application 60/253,617 filed Nov. 28, 2000.

FIELD OF THE INVENTION

The present invention relates to a low-smoke, highly flame-retardant, and flexible dual layer insulation system which demonstrates improved cut-through resistance. More specifically, the present invention relates to a dual layer insulation system comprising a cross-linked, highly flame-retardant, and halogen-free first insulating layer and a tough, flexible second insulating layer, and to insulated wires and conductors employing such an insulation system.

BACKGROUND OF THE INVENTION

Insulating materials for electrical wires are required to be not only flame-retardant but also, upon flaming, smoke suppressed and non-hazardous (i.e., productive of no harmful gases). Resins containing either halogen atoms in the molecular structure or a flame-retarding amount of a halogen compound cannot be used for this purpose, where such resins evolve corrosive, harmful hydrogen halide gases upon flaming.

Attempts to impart flame-retardancy to halogen-free resins have relied solely upon relatively high loadings of halogen-free, flame-retarding agents. Hydroxides and carbonates of certain metals, such as aluminum hydroxide, magnesium hydroxide and magnesium carbonate, as well as, zinc borate are well known in the art as suitable halogen-free, flame-retarding agents.

Unfortunately, such high loadings of halogen-free, flame-retarding agents adversely impacts upon the mechanical properties (e.g., toughness, flexibility) and processability of the resulting insulating material. Moreover, room temperature and elevated temperature cut-through resistance demonstrated by such prior art materials is inadequate for certain end-use applications including, but not limited to, electronics applications such as secondary power switching equipment for telephonic exchanges.

Accordingly, there is a need for low-smoke, highly flame-retardant, and flexible insulating materials which employ halogen-free resins and flame-retarding agents and which overcome the drawbacks associated with the prior art.

It is therefore a primary object of the present invention to provide such a low-smoke, highly flame-retardant, and flexible insulating material.

It is a more particular object of the present invention to provide a low-smoke, highly flame-retardant, and flexible dual layer insulation system which employs halogen-free resins and flame-retarding agents and which demonstrates improved cut-through resistance.

It is another more particular object of the present invention to provide insulated wires or conductors, which employ such an insulation system.

It is yet another more particular object to provide a process for preparing such insulated wires or conductors, wherein the insulation system comprises tightly adhered insulating layers.

SUMMARY OF THE INVENTION

The present invention therefore provides a dual layer insulation system, which comprises:

a) a first insulating layer having a thickness and comprising a cross-linked, highly flame-retardant, and halogen-free resin composition, wherein said resin composition comprises: 100 parts by weight of a thermoplastic resin; from about 100 to about 250 parts by weight of at least one flame-retarding agent; and from about 1 to about 10 parts by weight of an organosilicon compound represented by the formula:

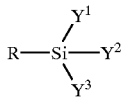

wherein R represents an alkyl group containing an acrylic or methacrylic group and wherein $Y^1$, $Y^2$, and $Y^3$ each represents a group selected from an alkyl group, an alkoxyl group, and mixtures thereof; and b) a second insulating layer having a thickness and comprising a thermoplastic material selected from alloys of polyolefins and polyamides, polyamides, polyamide/polyether block copolymers, polyesters, polyethylenes, polyurethanes and mixtures thereof, wherein the thickness of the second insulating layer is at least 4 percent of the thickness of the first insulating layer.

The present invention further provides an insulated conductor, which comprises:

a) a conductor having an outer surface;

b) a first insulating layer, as described above, provided directly on the outer surface of the conductor; and c) a second insulating layer, also as described above, provided directly on top of the first insulating layer, wherein the thickness of the second insulating layer is at least 4 percent of the thickness of the first insulating layer.

In another embodiment, the insulated conductor of the present invention comprises a plurality of bunched, twisted or bundled wires, wherein the wires are coated either directly or indirectly with the dual layer insulation system described hereinabove.

The present invention also provides a process for preparing an insulated conductor comprising a conductor and at least two tightly-adhered, extruded, insulating layers provided thereon, wherein said process comprises:

(a) increasing the force under which molten material used to prepare an outer insulating layer is applied to an inner insulating layer provided on the conductor by impeding or constricting the flow of said molten material; and/or (b) increasing the period of time in which the extruded, insulating layers are in contact prior to solidification by cooling the layers via ambient air cooling.

The foregoing and other features and advantages of the present invention will become more apparent from the following description.

DETAILED DESCRIPTION OF THE INVENTION

By way of the present invention, it has been discovered that a balance of properties (i.e., sufficient smoke suppression and flame-retardancy, flexibility, and improved cut-through resistance) can be achieved by a dual layer insulation system comprising a cross-linked, highly flame-retardant, and halogen-free first insulating layer and a tough, flexible second insulating layer, if the thickness of the second insulating layer is at least 4 percent of the thickness of the first insulating layer.

It has also been discovered that notably enhanced elevated temperature cut-through resistance is demonstrated by the inventive dual layer insulation system when the thermoplastic material of the second insulating layer is a flame-retarded polyamide 11.

The dual layer insulation system of the present invention offers several key benefits. For example, the flexibility demonstrated by the inventive insulation system facilitates installation and routing of wires and conductors used in various electronic applications. In addition, the first or inner insulating layer provides flame resistance over the useful life of the wire or conductor, while the second or outer layer provides toughness, thereby improving the resistance of the wire/conductor to physical abuse during installation and maintenance. This, in turn, reduces the possibility of electrical shock.

As noted above, the cross-linked and halogen-free resin composition of the first insulating layer of the dual layer insulation system of the present invention is highly flame-retardant. Flame-retardancy is generally measured by the Limiting Oxygen Index (LOI), which is basically the amount of oxygen needed in the atmosphere to support combustion. Insulated wires/conductors with an LOI greater than 28 are said to be flame-retardant, in that, there must be at least 28% oxygen present, for them to burn. The higher the LOI, the more flame-retardant the insulated wire/conductor.

The first insulating layer of the present invention demonstrates an LOI of at least 30, and preferably demonstrates an LOI of at least 40.

The resin composition of the first insulating layer is described in U.S. Pat. No. 5,236,985, which is incorporated herein by reference. More specifically, thermoplastic resins suitable for use in the cross-linked, highly flame-retardant, and halogen-free resin composition include polyethylene, ethylene-α-olefin copolymers, ethylene-propylene thermoplastic elastomers, ethylene-vinylacetate copolymers, ethylene-ethylacrylate copolymers, ethylene-methylmethacrylate copolymers, ethylene-methacrylic acid copolymers, ethylene-methylacrylate copolymers and the like.

The thermoplastic resins may be used alone or as a mixture of two or more resins. In a preferred embodiment, the thermoplastic resin is either an ethylene-vinylacetate copolymer having a melt index of from about 0.5 to about 5 and a vinylacetate content of from about 28 to about 45% by weight, or an ethylene-ethylacrylate copolymer having a melt index of from about 0.5 to about 5 and an ethylacrylate content of from about 9 to about 25% by weight. Such resins are available from DuPont Co., Wilmington, Del. 19898, under the product designations ELVAX and EVAFLEX, respectively.

Suitable flame-retarding agents include aluminum trihydrate, clay, magnesium carbonate, metal hydroxides (e.g., aluminum hydroxide, magnesium hydroxide), talc, and mixtures thereof.

In a preferred embodiment, the flame-retarding agent is magnesium hydroxide, which is available from Kyowa Chemical Industry Co., Ltd., Sakaide, Kagawa 762-0012, Japan, under the product designation KISUMA 5.

The flame-retarding agent is present in the dual layer insulation system of the present invention in an amount ranging from about 100 to about 250 parts by weight, preferably from about 150 to about 200 parts by weight, per 100 parts by weight of the thermoplastic resin.

Examples of the organosilicon compound represented by formula:

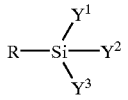

where R represents an alkyl group containing an acrylic or methacrylic group and where $Y^1$, $Y^2$, and $Y^3$ each represents a group selected from the group consisting of an alkyl group, an alkoxyl group, and mixtures thereof, include: γ-methacryloxypropyltrimethoxysilane, γ-methacryloxypropyltriethoxysilane, γ-acryloxypropyltrimethoxysilane, γ-methacryloxypropyldimethoxymethylsilane, γ-methacryloxypropyldimethylchorosilane and the like.

In a preferred embodiment, the organosilicon compound is γ-methacryloxypropyltrimethoxysilane, available from OSi Specialties, A Crompton Corp., One American Lane, Greenwich, Conn. 06831 2559, under the product designation SILANE A-174.

The organosilicon compound is present in the first insulating layer of the dual layer insulation system of the present invention in an amount ranging from about 1 to about 10 parts by weight, preferably from about 2 to about 5 parts by weight, per 100 parts by weight of the thermoplastic resin.

In addition to the above components, the cross-linked, highly flame-retardant resin composition of the first insulating layer of the dual layer insulation system of the present invention can advantageously contain other non-halogen additives such as antioxidants, anti-tack agents, cross-linking agents, metal deactivators and processing aids, provided any such additive(s) does not adversely impact upon the flame-retardant properties of the first insulating layer.

In a preferred embodiment, the highly flame-retardant resin composition of the first insulating layer comprises: 100 parts by weight of either an ethylene-vinylacetate copolymer or an ethylene-ethylacrylate copolymer; from about 150 to about 200 parts by weight of magnesium hydroxide; and from about 2 to about 5 parts by weight of either γ-methacryloxypropyltrimethoxysilane or γ-ethacryloxypropyldimethoxymethylsilane.

The components of the resin composition can be blended together by any conventional process until a uniform mix is obtained. In particular, the components can be introduced into an extruder, melt-blended and then extruded over wire or cable. The term "melt-blended", as used herein, means blending at a temperature high enough to maintain the thermoplastic resin in a molten state. No specific melt-blending conditions are required.

As will be readily appreciated by those skilled in the art, cross-linking is effected by exposing the resin composition to ionizing radiation (e.g., electron beams, B-rays, X-rays and γ-rays). In a preferred embodiment, the resin composition is exposed to a dose of ionizing radiation ranging from about 3 to about 50 Mrad, preferably from about 5 to about 25 Mrad.

The first insulating layer has a thickness of at least about 0.6 millimeters (mm). It has been found that insulating layers having thicknesses falling below 0.6 mm, fail to satisfy the stringent requirements of the UL VW-1 Vertical Flame Test.

In a preferred embodiment, the thickness of the first insulating layer ranges from about 0.6 to about 0.75 mm.

Due to the high loadings of flame-retarding agents in the first insulating layer, this layer tends to be somewhat stiff. The stiffness of this layer is off-set, to a certain degree, by the thermoplastic material of the second insulating layer, which has a flexural modulus (ASTM D-790) of less than 20,000 kilograms per square centimeter ($kg/cm^2$), preferably less than 10,000 $kg/cm^2$.

Thermoplastic materials suitable for use in the second insulating layer of the present invention include alloys of polyolefins and polyamides, polyamides, polyamide/polyether block copolymers, polyesters, polyethylenes and polyurethanes.

The thermoplastic materials may be used alone or as a mixture of two or more materials.

The thermoplastic material of the second insulating layer can advantageously contain other additives such as halogen-free, flame-retarding agents, plasticizers, and light and heat stabilizers, provided any such additive(s) does not adversely impact upon the flexibility or cut-through resistance of the second insulating layer.

Preferably, the thermoplastic material is polyamide 11 (i.e., PA 11 or nylon 11) and more preferably, is an extrusion grade or plasticized polyamide 11.

In a most preferred embodiment, the thermoplastic resin is a flame-retarded polyamide 11, which is available from Atofina Chemicals, Inc., 2000 Market St., Philadelphia, Pa. 19103-3222, under the product designation RILSAN MB-3000 flame-retarded polyamide 11. The RILSAN MB-3000 flame-retarded polyamide 11 is described in U.S. Pat. No. 6,239,219 B1, which is incorporated herein by reference.

The thermoplastic resin of the second insulating layer is preferably melt-extruded over the extruded and cross-linked first insulating layer. The first and second insulating layers may also be formed at the same time (i.e., co-extruded). For co-extruded layers, a subsequent irradiation step would serve to cross-link the first insulating layer, without substantially impacting upon the degree of cross-linking present in the second insulating layer.

In a more preferred embodiment, the melt-extrusion conditions are controlled in such a way that the first and second insulating layers are held tightly in contact with each other. Such tight contact between the two insulating layers advantageously impacts upon the flexibility of the resulting insulation system and is achieved by (1) increasing the force under which molten material used to prepare the second/outer insulating layer is applied to the first/inner insulating layer by impeding or constricting the flow of the molten material, and/or (2) increasing the period of time in which the extruded, insulating layers are in contact prior to solidification by cooling the layers via ambient air cooling. As will be evident to those skilled in the art, the flow of molten material in an extruder may be constricted by using special tooling within the crosshead section of the extruder. For example, the distance between the exiting end of the tip and the die orifice can be adjusted back against the direction of the material flow. In a preferred embodiment, the retraction of the tip from the orifice is about 3 mm.

It has been discovered that when the above-referenced techniques are employed, tight adhesion between the insulating layers is achieved. It has also been discovered that the degree of adhesion is inversely proportional to the thickness of the second insulating layer. In other words, as the thickness of the second insulating layer decreases, the adhesion between the first and the second insulating layers increases.

The second insulating layer has a thickness of at least about 0.025 mm. It has been found that insulating layers having thicknesses falling below 0.025 mm, fail to demonstrate satisfactory room temperature and elevated temperature cut-through resistance.

In a preferred embodiment, the thickness of the second insulating layer ranges from about 0.025 to about 0.13 mm.

As stated above, by way of the present invention, it has been discovered that sufficient smoke suppression and flame-retardancy, flexibility and improved cut-through resistance can be achieved by a dual layer insulation system comprising a cross-linked, highly flame-retardant, and halogen-free first insulating layer and a tough, flexible second insulating layer, if the thickness of the second insulating layer is at least 4 percent of the thickness of the first insulating layer. More specifically, by way of the present invention, it has been discovered that when the thermoplastic material of the second insulating layer is a polyamide (i.e., polyamide 6, polyamide 6/12, polyamide 11) or an alloy of a polyolefin and a polyamide, the ratio of the thickness of the first insulating layer to the thickness of the second insulating layer must fall within the range of from about 1:0.04 to less than 1:0.22. Insulation systems having a layer thickness ratio of 1:0.22 and above (i.e., systems where the thickness of the second insulating layer is greater than or equal to 22% of the thickness of the first insulating layer), fail to satisfy the stringent requirements of the UL VW-1 Vertical Flame Test, while systems having a layer thickness ratio of less than 1:0.04 (i.e., systems where the thickness of the second insulating layer is less than 4% of the thickness of the first insulating layer), fail to demonstrate satisfactory room temperature and elevated temperature cut-through resistance.

It is noted, however, that when the thermoplastic material of the second insulating layer is a flame-retarded polyamide 11, it is not necessary to stay within the above-referenced layer thickness ratio range. More specifically, insulation systems which employ this material and which have layer thickness ratios of 1:0.22 and above, will continue to satisfy the requirements of the UL VW-1 Vertical Flame Test.

By way of the present invention, it has also been discovered that when the thermoplastic material is a polyester, a polyamide/polyether block copolymer or a polyethylene (e.g., high density polyethylene or HDPE), the ratio of the thickness of the first insulating layer to the thickness of the second insulating layer must fall within the range of from about 1:0.04 to less than 1:0.29. Insulation systems having a layer thickness ratio of 1:0.29 and above, fail to satisfy the stringent requirements of the UL VW-1 Vertical Flame Test, while systems having a layer thickness ratio of less than 1:0.04, fail to demonstrate satisfactory room temperature and elevated temperature cut-through resistance.

It has further been discovered that when the thermoplastic material is a polyurethane, the ratio of the thickness of the first insulating layer to the thickness of the second insulating layer must fall within the range of from about 1:0.04 to less than 1:0.36.

The insulated wire or conductor of the present invention comprises:

a) a conductor having an outer surface;

b) a first insulating layer, as described above, provided directly on the outer surface of the conductor; and c) a second insulating layer, also as described above, provided directly on top of the first insulating layer, wherein the thickness of the second insulating layer is at least 4 percent of the thickness of the first insulating layer.

The conductor may consist of copper, copper alloy, copper plated with tin, nickel, silver, or the like. The conductor may be either solid or stranded.

The thickness or outside diameter of the insulated wire or conductor ranges from about 2 to about 10 mm, preferably from about 4.5 to about 6.0 mm.

In one embodiment, the insulated conductor of the present invention comprises a plurality of insulated wires, which are either bunched, twisted or bundled together.

In a preferred embodiment, the insulated conductor comprises a plurality of the dual layer insulated wires of the present invention. In a more preferred embodiment, the bunched, twisted or bundled wires are covered with a sheath prepared from a halogen-free resin composition.

In another preferred embodiment, the insulated conductor comprises a plurality of single layer insulated wires, which are coated with the first insulating layer. In this embodiment, the bunched, twisted or bundled single layer insulated wires are covered with a sheath consisting of the second insulating layer.

The insulated wires or conductors of the present invention meet or exceed the requirements of UL VW-1 Vertical Flame Test. As is well known by those skilled in the art, the UL VW-1 Vertical Flame Test is used as a criterion for measuring the propagation of flame along a length of an insulated conductor supported vertically with the lower end exposed by a laboratory burner to five-15 second exposures of flame.

The inventive insulated wires or conductors also meet or exceed the requirements of the American National Standards Institute/Institute of Electrical and Electronics Engineers (ANSI/IEEE) Standard 383-1974 Flame Test of Class 1E Electric Cables, rendering them suitable for use outside of fire-proof or flame-resistant electrical cabinets.

The insulated wires or conductors of the present invention also meet or exceed the requirements of the smoke density test established by the International Electrotechnical Commission (IEC), in its test specification number IEC 61034-2. In accordance with the test protocol set forth in IEC 61034-2, multiple bundles of wire are exposed to standard thermal conditions of pyrolysis and combustion in a continuous (40 minute) procedure. The change in the % Transmission within a fixed volume of air caused by the smoke produced by the heated wire bundles is recorded throughout the period of the test. The test is deemed passed if the minimum recorded % Transmission is greater than or equal to 60%.

In addition, the inventive insulated wires or conductors demonstrate room temperature/elevated temperature cut-through resistance comparable to that demonstrated by prior art wires/conductors, which are insulated with halogenated materials. More specifically, the insulated wires or conductors of the present invention demonstrate a cut-through resistance ranging: from about 30 to about 80 pounds (lbs.), preferably from about 50 to about 60 lbs., at room temperature (23° C.); from about 20 to about 60 lbs., preferably from about 30 to about 40 lbs., at 60° C.; and from about 10 to about 40 lbs., preferably from about 20 to about 30 lbs., at 90° C.

The present inventors have made the surprising discovery that the use of a flame-retarded polyamide 11 in the second insulating layer of the present invention, does not adversely impact upon the elevated temperature cut-through resistance. More specifically, the insulated wires or conductors of the present invention, which employ a flame-retarded polyamide 11, demonstrate a cut-through resistance ranging: from about 20 to about 60 lbs., preferably from about 40 to about 50 lbs., at 60° C.; and from about 15 to about 45 lbs., preferably from about 25 to about 35 lbs., at 90° C. Such a relatively high value in elevated temperature cut-through resistance is especially surprising in view of the fact that flame-retarded polyamide 11 has a melting point which is lower than polyamide 6 and polyamide 6/12.

The invention is now described with reference to the following examples, which are for the purpose of illustration only and are not intended to imply any limitation on the scope of the invention.

SPECIFIC EMBODIMENTS

Components Used

1. First Insulating Layer.

EVA (VA 46%): an ethylene vinyl acetate copolymer having a vinyl acetate content of 46% and a melt index of 2.5 g/10 min, available from DuPont Co., under the trade designation EVAFLEX EV45 LX.

FLAME RETARDANT: a non-coated magnesium hydroxide flame retardant, available from Kyowa Chemical Industry Co., Ltd., under the trade designation KISUMA 5.

FILLER: a calcium carbonate filler, available from Shiraishi Calcium Co., Ltd., Japan, under the trade designation HAKUENKA CC-R.

ANTIOXIDANT(I): a hindered phenolic antioxidant, available from Ciba-Geigy Corp., Hawthorne, N.Y., under the trade designation IRGANOX 1010.

ANTIOXIDANT(II): a thioester secondary antioxidant, available from Argus Chemical Corporation, 633 Court St., Brooklyn, N.Y., 11231, under the trade designation SEENOX 412S.

COUPLING AGENT: a silane coupling agent, available from OSi Specialties, A Crompton Corp., One American Lane, Greenwich, Conn. 06831 2559, under the trade designation SILANE A-174.

METAL DEACTIVATOR: a substituted amino triazole metal deactivator, available from Amfine Chemical Corporation, 6 Pearl Court, Allendale, N.J., 07401, under the trade designation ADK Stabilizer CDA-1.

ANTI-TACK AGENT: a fatty amide anti-tack agent, available from NOF Corporation, 4-20-3, Ebisu, Shibuya-ku, Tokyo 150, Japan, under the trade designation ALFLOW E-10.

2. Second Insulating Layer.

N11: an extrusion grade, heat and light stabilized polyamide (nylon) 11 resin, available from Atofina Chemicals, Inc., 2000 Market St., Philadelphia, Pa. 19103-3222, under the trade designation RILSAN BESNO P40 TL.

N 6/12: an extrusion grade, heat and light stabilized polyamide (nylon) 6/12 resin, available from DuPont Co., under the trade designation ZYTEL 350 PHS.

N6: an extrusion grade, heat and light stabilized polyamide (nylon) 6 resin, available from Honeywell Industrial Automation & Control, Phoenix Ariz. 85053, under the trade designation CAPRON 8224 HSL.

TPA: an unprocessed polyolefin/nylon thermoplastic alloy, available from Atofina Chemicals, under the trade designation ORGALLOY LE.

FR-N11: a halogen-free, flame-retarded polyamide 11 resin, available from Atofina Chemicals, under the trade designation RILSAN MB-3000.

POLYESTER: a polyester resin, available from DuPont Co., under the trade designation HYTREL ETP 1383.

HDPE: a high density polyethylene resin, available from Equistar Chemicals Company, 1045 North Kemp Street, Anaheim, Calif. 92801, under the trade designation LR5900-05.

TPU: a thermoplastic polyurethane resin, available from Noveon Inc. (formally BF Goodrich), 9911 Brecksville Road, Cleveland, Ohio 44141, under the trade designation ESTANE 58325.

PEBA: a polyamide/polyether block copolymer, available from Atofina Chemicals, under the trade designation PEBAX 4033.

Sample Preparation

1. Preparation, Extrusion, and Cross-Linking of First Insulating Layer.

Wires coated with the first insulating layer were prepared in accordance with the teachings of U.S. Pat. No. 5,236,985. More specifically, highly flame-retardant, and halogen-free resin compositions were prepared by melt kneading ingredients in accordance with the formulations shown in Tables 1 to 3, hereinbelow. Melt kneading was conducted in a Banbury mixer at temperatures of between 160 and 180° C. The resulting hot molten material was cooled slightly, discharged from the mixer at temperatures of between 100 and 120° C., and then passed through a single-screw extruder, cooled, and pelletized.

A multi-zone, single-screw extruder was used to extrude the pelletized compositions. More specifically, the pelletized compositions identified in Tables 1 and 2, were extruded over 10 American Wire Gage (AWG) tin plated copper wires measuring 3.2 mm in diameter, while the pelletized compositions identified in Table 3, were extruded over 26 AWG 19/38 (0.48 mm diameter), 14 AWG 41/30 (1.79 mm diameter) and 4 AWG 133/25 (6.60 mm diameter) tin plated copper wires. Zone temperatures in the multi-zone, single-screw extruder gradually increased from 120 to 170° C. Extruded coating thicknesses varied and are reported in Tables 1 to 3.

A control sample was also prepared at this time.

The coated wire samples were then irradiated using electron-beam radiation, with air-cooling. Total dosage was 5 to 35 Mrad.

2. Preparation and Extrusion of Second Insulating Layer.

Resins identified in Tables 1 to 3, were melt kneaded in a single-screw extruder, and then extruded over the coated wire samples in accordance with the methods or techniques described above, at temperatures of between: 185 to 205° C. (N11); 180 to 210° C. (FR-N11); 220 to 240° C. (N 6/12); 225 to 265° C. (N6); 240 to 270° C. (TPA); 220 to 245° C. (POLYESTER); 260 to 280° C. (HDPE); 155 to 190° C. (TPU); and 210 to 230° C. (PEBA). Extruded coating thicknesses varied and are reported in Tables 1 to 3.

The above-identified insulated wire samples were subjected to the following tests.

Test Methods

VW-1 Flame (P,F): The insulated wire samples were tested for flame resistance in accordance with the test method set forth in the UL VW-1 Flame Test. In this test, insulated wire samples, each measuring approximately 450 mm in length, were supported vertically in a rectangular test apparatus housed within a draft-free chamber. The draft-free chamber had greater than or equal to 4 $m^3$ of interior volume. The lower end of each wire sample was exposed, by a laboratory burner (as described in ANSI/ASTM D 5025-94) positioned at a 20° angle from the vertical plane of the longitudinal axis of the wire, to five-15 second exposures of flame. The period between exposures was: 15 seconds, if flaming ceased in less than or equal to 15 seconds; or, the duration of flaming, if flaming persisted for greater than 15 seconds. A flat, 6 mm thick layer of dry, surgical cotton was positioned on a bottom tray of the test apparatus. The bottom tray measured 300 mm in width and 355 mm in depth, and was positioned 230 to 240 mm from the lower end of each wire sample. A kraft paper flag, measuring 10 mm in width and 0.5 mm in thickness, was placed 250 mm above the lower end of each wire sample, where the flame was to touch the sample. The test was deemed passed if: (1) the fire from the flaming wire sample extinguished within 60 seconds for each of the five exposures; and (2) the absorbent cotton and the kraft paper flag did not catch fire.

Cut-Through Resistance (lbs): The insulated wire samples were tested for cut-through resistance using the method described below. The cut-through test measured the resistance of the wire insulation to the penetration of a cutting surface and simulated the type of damage that can occur when a wire is forced by mechanical loading against a sharp edge. The test was performed at room temperature (23° C.), at 60° C., and at 90° C., to evaluate the effect of the elevated temperature on insulation performance. The standard cutting edge used was stainless steel and had a radius of 0.406 mm.

For each test, the wire from an insulated wire sample measuring 75 mm in length, was removed and replaced with a steel mandrel having the same outside diameter as the wire. The sample was then clamped in place between a blade and a flat plate within an INSTRON compression tester, and the ends of the steel mandrel connected to an 18 VDC electrical circuit. The cutting edge of the blade was oriented perpendicularly to the axis of the sample. The cutting edge was then forced through the insulation at a constant rate of 1.27 mm per minute until contact with the steel mandrel occurred. A detection circuit sensed contact of the cutting edge with the steel mandrel and recorded the maximum force encountered during the test. The test was then repeated two times rotating the sample between tests to offset the effect of eccentric insulation. The reported cut-through resistance was the arithmetic mean of three tests performed on each sample.

Flame Propagation Resistance (P,F): Three sets of three insulated wire samples, each set having a different wire size, were tested for flame propagation resistance in accordance with the test method set forth in the ANSI/IEEE Standard 383-1974 Flame Test of Class 1E Electric Cables. Samples passing this test did not propagate fire even when the insulation had been destroyed in the area of flame impingement and, as such, qualified for use outside of a fire-proof or flame-resistant electrical cabinet. 2.44 m lengths of insulated wire samples were positioned in a single layer filling at least the center 15 cm portion of a steel, ladder vertical cable tray, measuring 7.6 cm deep, 30.5 cm wide and 2.4 m long. The flame test was supplied by means of a 25.4 cm wide, 11-55 drilling ribbon-type burner, and an air/gas Venturi mixer. The burner was mounted horizontally 61 cm from the bottom of the cable tray. The burner was located in the front of the insulated wire samples so that the flame impinged on the samples midway between the tray rungs and 10 cm from the closed surface of the insulated wire samples.

The flame, which was produced by a mixture of 4.616 cubic meters per hour of air and 0.7929 cubic meters per hour of propane, generated 70,000 BTU/hour of power. The flame length was approximately 38 cm and the flame temperature, which was measured by a thermocouple located in the flame close to but not touching the surface of the insulated wire samples, was approximately 816° C. The flame was applied to the insulated wire samples for 20 minutes, after which time it was extinguished and the insulation fire (if any) allowed to burn out. The maximum height of damage to the insulated wire samples was determined by measuring the blistering char upward from the lower edge of the burner face. After flaming had ceased, the samples were wiped clean and the longest charred or affected portion of the samples measured and recorded to the nearest 2.5 cm. Damage to each insulated wire sample was determined by measuring the distance of charring or the affected portion above the horizontal line from the lower edge of the burner face. The limit of charring was determined by pressing against the insulated wire surfaces with a sharp object and locating those portions where the surface changed from a resilient surface to a brittle or crumbling surface. Distortion of the outer surface of the insulated wires, such as blistering or melting immediately above the char, was included in the damage measurement. For samples, which did not have charring, the limit for the affected portion was defined as the point where the overall diameter was visibly reduced or increased. Sample failure occurred when any portion of any insulated wire sample burned to the top of the tray, either during or after the 20-minute exposure period.

EXAMPLES 1 to 16 AND COMPARATIVE EXAMPLES C-1 and C-2

In Examples 1 to 16 and Comparative Examples C-1 and C-2, wires employing a dual insulation system having various thicknesses for the second insulating layer along with prior art insulated wires were tested for flame and cut-through resistance. The results are tabulated in Table 1, hereinbelow.

TABLE 1

Summary of Examples 1 to 16 and Comparative Examples C-1 and C-2

| EXAMPLE | 1 | 2 | 3 | 4 | 5 | 6 | 7 | 8 | 9 |
|---|---|---|---|---|---|---|---|---|---|
| First Insulating Layer Components (parts by wt) | | | | | | | | | |
| EVA (VA 46%) | 100 | 100 | 100 | 100 | 100 | 100 | 100 | 100 | 100 |
| FLAME RETARDANT | 180 | 180 | 180 | 180 | 180 | 180 | 180 | 180 | 180 |
| FILLER | 20 | 20 | 20 | 20 | 20 | 20 | 20 | 20 | 20 |
| ANTIOXIDANT (I) | 2 | 2 | 2 | 2 | 2 | 2 | 2 | 2 | 2 |
| ANTIOXIDANT (II) | 1 | 1 | 1 | 1 | 1 | 1 | 1 | 1 | 1 |
| COUPLING AGENT | 2 | 2 | 2 | 2 | 2 | 2 | 2 | 2 | 2 |
| METAL DEACTIVATOR | 1 | 1 | 1 | 1 | 1 | 1 | 1 | 1 | 1 |
| ANTI-TACK AGENT | 1 | 1 | 1 | 1 | 1 | 1 | 1 | 1 | 1 |
| Thickness (mm) | 0.685 | 0.685 | 0.685 | 0.685 | 0.685 | 0.685 | 0.685 | 0.685 | 0.685 |
| Second Insulating Layer | | | | | | | | | |
| Material | N11 | N11 | N11 | N11 | N 6/12 | N 6/12 | N 6/12 | N 6/12 | TPA |
| Thickness (mm) | 0.10 | 0.15 | 0.20 | 0.25 | 0.10 | 0.15 | 0.20 | 0.25 | 0.10 |
| Layer Thickness Ratio | 1:0.15 | 1:0.22 | 1:0.29 | 1:0.36 | 1:0.15 | 1:0.22 | 1:0.29 | 1:0.36 | 1:0.15 |
| Properties | | | | | | | | | |
| VW-1 Flame (P, F) | P | F | F | F | P | F | F | F | P |
| Cut-Through Resistance (lbs) | | | | | | | | | |
| at 30° C. | 50.22 | 54.26 | 51.23 | 43.1 | 51.75 | — | — | — | 55.58 |
| at 60° C. | 27.96 | 17.57 | 28 55 | 19.6 | 21.01 | — | — | — | 21.83 |

TABLE 1-continued

| Summary of Examples 1 to 16 and Comparative Examples C-1 and C-2 | | | | | | | | | |
|---|---|---|---|---|---|---|---|---|---|
| at 90° C. | 12.06 | 17.27 | 13.25 | 12.78 | 15.83 | — | — | — | 20.28 |
| EXAMPLE | 10 | 11 | 12 | 13 | 14 | 15 | 16 | C-1[1] | C-2[2] |
| First Insulating Layer Components (parts by wt) | | | | | | | | | |
| EVA (VA 46%) | 100 | 100 | 100 | 100 | 100 | 100 | 100 | | |
| FLAME RETARDANT | 180 | 180 | 180 | 180 | 180 | 180 | 180 | | |
| FILLER | 20 | 20 | 20 | 20 | 20 | 20 | 20 | | |
| ANTIOXIDANT (I) | 2 | 2 | 2 | 2 | 2 | 2 | 2 | | |
| ANTIOXIDANT (II) | 1 | 1 | 1 | 1 | 1 | 1 | 1 | | |
| COUPLING AGENT | 2 | 2 | 2 | 2 | 2 | 2 | 2 | | |
| METAL DEACTIVATOR | 1 | 1 | 1 | 1 | 1 | 1 | 1 | | |
| ANTI-TACK AGENT | 1 | 1 | 1 | 1 | 1 | 1 | 1 | | |
| Thickness (mm) | 0.685 | 0.685 | 0.685 | 0.685 | 0.685 | 0.685 | 0.685 | | |
| Second Insulating Layer | | | | | | | | | |
| Material | TPA | TPA | TPA | N6 | N6 | N6 | N6 | | |
| Thickness (mm) | 0.15 | 0.20 | 0.25 | 0.10 | 0.15 | 0.20 | 0.25 | 0.10 | 0.30 |
| Layer Thickness Ratio | 1:0.22 | 1:0.29 | 1:0.36 | 1:0.15 | 1:0.22 | 1:0.29 | 1:0.36 | | |
| Properties | | | | | | | | | |
| VW-1 Flame (P, F) | F | F | F | P | F | F | F | P | P |
| Cut-Through Resistance (lbs) | | | | | | | | | |
| at 30° C. | — | — | — | 75.1 | | | | 85.5 | 91.4 |
| at 60° C. | — | — | — | 46.7 | | | | 35.3 | 53.3 |
| at 90° C. | — | — | — | 39.3 | | | | 22.4 | 32.7 |

[1]Comparative Example C-1 is a thermoplastic, high heat resistant, nylon coated (THHN) polyvinyl chloride (PVC)/nylon insulated wire product sold by American Insulated Wire, Corp., Pawtucket, RI 02861-0880.
[2]Comparative Example C-2 is a PVC/Cottonbraid insulated wire product also sold by American Insulated Wire, Corp.

As shown in Table 1, the insulated wires of the present invention (i.e., Examples 1, 5, 9, and 13) demonstrate flame and cut-through resistance properties comparable to those demonstrated by prior art insulated wires prepared from halogenated insulating materials (i.e., Comparative Examples C-1 and C-2). As further shown in Table 1, insulated wires having layer thickness ratios that fall outside the ranges noted herein (i.e., Examples 2 to 4, 6 to 8, 10 to 12, and 14 to 16) fail to meet or exceed the stringent requirements of UL VW-1 Vertical Flame Test.

EXAMPLES 17 to 36 AND COMPARATIVE EXAMPLE C-3

In Examples 17 to 36, wires jacketed with a dual layer insulation system having second insulating layers, which employed various thermoplastic materials at different layer thicknesses, were tested for flame and cut-through resistance. In Comparative Example C-3, a wire jacketed with a single layer insulation system having a thickness of 0.787 mm, was also tested for flame and cut-through resistance. The results are tabulated in Table 2, hereinbelow.

TABLE 2

| Summary of Examples 17 to 36 and Comparative Example C-3 | | | | | | | | | | |
|---|---|---|---|---|---|---|---|---|---|---|
| EXAMPLE | 17 | 18 | 19 | 20 | 21 | 22 | 23 | 24 | 25 | 25 |
| First Insulating Layer Components (parts by wt) | | | | | | | | | | |
| EVA (VA 46%) | 100 | 100 | 100 | 100 | 100 | 100 | 100 | 100 | 100 | 100 |
| FLAME RETARDANT | 180 | 180 | 180 | 180 | 180 | 180 | 180 | 180 | 180 | 180 |
| FILLER | 20 | 20 | 20 | 20 | 20 | 20 | 20 | 20 | 20 | 20 |
| ANTIOXIDANT (I) | 2 | 2 | 2 | 2 | 2 | 2 | 2 | 2 | 2 | 2 |
| ANTIOXIDANT (II) | 1 | 1 | 1 | 1 | 1 | 1 | 1 | 1 | 1 | 1 |
| COUPLING AGENT | 2 | 2 | 2 | 2 | 2 | 2 | 2 | 2 | 2 | 2 |

TABLE 2-continued

| | | | | | | | | | | |
|---|---|---|---|---|---|---|---|---|---|---|
| METAL DEACTIVATOR | 1 | 1 | 1 | 1 | 1 | 1 | 1 | 1 | 1 | 1 |
| ANTI-TACK AGENT | 1 | 1 | 1 | 1 | 1 | 1 | 1 | 1 | 1 | 1 |
| Thickness (mm) | 0.685 | 0.685 | 0.685 | 0.685 | 0.685 | 0.685 | 0.685 | 0.685 | 0.685 | 0.685 |
| Second Insulating Layer | | | | | | | | | | |
| Material | FR-N11 | FR-N11 | FR-N11 | FR-N11 | POLY ESTER | POLY ESTER | POLY ESTER | POLY ESTER | HDPE | HDPE |
| Thickness (mm) | 0.10 | 0.15 | 0.20 | 0.25 | 0.10 | 0.15 | 0.20 | 0.25 | 0.10 | 0.15 |
| Layer Thickness Ratio | 1:0.15 | 1:0.22 | 1:0.29 | 1:0.36 | 1:0.15 | 1:0.22 | 1:0.29 | 1:0.36 | 1:0.15 | 1:0.22 |
| Properties | | | | | | | | | | |
| VW-1 Flame (P, F) | P | P | P | P | P | P | F | F | P | P |
| Cut-Through Resistance (lbs) | | | | | | | | | | |
| at 30° C. | 50.25 | 52.47 | 59.01 | 75.29 | 40.16 | 48.24 | 55.78 | 59.86 | 32.25 | 40.03 |
| at 60° C. | 23.80 | 27.72 | 38.03 | 47.34 | 12.72 | 18.05 | 18.63 | 23.03 | 15.91 | 17.57 |
| at 90° C. | 19.55 | 18.54 | 20.16 | 28.51 | 8.3 | 10.04 | 13.38 | 14.21 | 10.47 | 9.37 |

| EXAMPLE | 27 | 28 | 29 | 30 | 31 | 32 | 33 | 34 | 35 | 36 | C-3 |
|---|---|---|---|---|---|---|---|---|---|---|---|
| First Insulating Layer Components (parts by wt) | | | | | | | | | | | |
| EVA (VA 46%) | 100 | 100 | 100 | 100 | 100 | 100 | 100 | 100 | 100 | 100 | 100 |
| FLAME RETARDANT | 180 | 180 | 180 | 180 | 180 | 180 | 180 | 180 | 180 | 180 | 180 |
| FILLER | 20 | 20 | 20 | 20 | 20 | 20 | 20 | 20 | 20 | 20 | 20 |
| ANTIOXIDANT (I) | 2 | 2 | 2 | 2 | 2 | 2 | 2 | 2 | 2 | 2 | 2 |
| ANTIOXIDANT (II) | 1 | 1 | 1 | 1 | 1 | 1 | 1 | 1 | 1 | 1 | 1 |
| COUPLING AGENT | 2 | 2 | 2 | 2 | 2 | 2 | 2 | 2 | 2 | 2 | 2 |
| METAL DEACTIVATOR | 1 | 1 | 1 | 1 | 1 | 1 | 1 | 1 | 1 | 1 | 1 |
| ANTI-TACK AGENT | 1 | 1 | 1 | 1 | 1 | 1 | 1 | 1 | 1 | 1 | 1 |
| Thickness (mm) | 0.685 | 0.685 | 0.685 | 0.685 | 0.685 | 0.685 | 0.685 | 0.685 | 0.685 | 0.685 | 0.787 |
| Second Insulating Layer | | | | | | | | | | | |
| Material | HDPE | HDPE | TPU | TPU | TPU | TPU | PEBA | PEBA | PEBA | PEBA | N/A |
| Thickness (mm) | 0.20 | 0.25 | 0.10 | 0.15 | 0.20 | 0.25 | 0.10 | 0.15 | 0.20 | 0.25 | N/A |
| Layer Thickness Ratio | 1:0.29 | 1:0.36 | 1:0.15 | 1:0.22 | 1:0.29 | 1:0.36 | 1:0.15 | 1:0.22 | 1:0.29 | 1:0.36 | N/A |
| Properties | | | | | | | | | | | |
| VW-1 Flame (P, F) | F | F | P | P | P | F | P | P | F | F | P |
| Cut-Through Resistance (lbs) | | | | | | | | | | | |
| at 30° C. | 54.52 | 48.83 | 41.3 | 43.05 | 49.75 | 53.98 | 43.08 | 46.84 | 46.98 | 44.3 | 36.85 |
| at 60° C. | 14.64 | 20.35 | 11.73 | 12.91 | 10.47 | 17.3 | 9.86 | 12.5 | 15.82 | 15.49 | 9.27 |
| at 90° C. | 12.29 | 14.0 | 7.35 | 7.5 | 8.95 | 10.74 | 8.68 | 7.39 | 7.73 | 10.03 | 2.75 |

As shown in Table 2, the insulated wires of the present invention (i.e., Examples 17 to 22, 25, 26, 29 to 31, 33 and 34) pass the UL VW-1 Flame Test and demonstrate good room and elevated temperature cut-through resistance. As further shown in Table 2, wires jacketed with a dual layer insulation system made up of a second insulating layer prepared from FR-N11 (i.e., Examples 17 to 20), satisfied the stringent requirements of the UL VW-1 Vertical Flame Test at each layer thickness tested, and demonstrated greatly improved elevated temperature cut-through resistance. Systems made up of a second insulating layer prepared from either PE, PEBA or HDPE (i.e., Examples 21 to 24, 33 to 36, 25 to 28, respectively) or TPU (i.e., Examples 29 to 32), on the other hand, must have layer thickness ratios of from about 1:0.04 to less than 1:0.29 or from about 1:0.04 to less than 1:0.36, respectively, in order to satisfy the UL VW-1 Vertical Flame Test. Comparative Example C-3, satisfied the UL VW-1 Vertical Flame Test, but demonstrated reduced room and elevated temperature cut-through resistance.

EXAMPLES 37 to 45

In Examples 37 to 45, three sets of three insulated wire samples, each set having a different wire size, were tested for flame propagation resistance. The results are tabulated in Table 3, hereinbelow.

TABLE 3

Summary of Examples 37 to 45

| EXAMPLE | 37 | 38 | 39 | 40 | 41 | 42 | 43 | 44 | 45 |
|---|---|---|---|---|---|---|---|---|---|
| Wire[3] | | | | | | | | | |
| AWG Size | 26 AWG 19/38 | 26 AWG 19/38 | 26 AWG 19/38 | 14 AWG 41/30 | 14 AWG 41/30 | 14 AWG 41/30 | 4 AWG 133/25 | 4 AWG 133/25 | 4 AWG 133/25 |
| Diameter (mm) | 0.48 | 0.48 | 0.48 | 1.79 | 1.79 | 1.79 | 6.60 | 6.60 | 6 60 |
| First Insulating Layer Components (parts by wt) | | | | | | | | | |
| EVA (VA 46%) | 100 | 100 | 100 | 100 | 100 | 100 | 100 | 100 | 100 |
| FLAME RETARDANT | 180 | 180 | 180 | 180 | 180 | 180 | 180 | 180 | 180 |
| FILLER | 20 | 20 | 20 | 20 | 20 | 20 | 20 | 20 | 20 |
| ANTIOXIDANT (I) | 2 | 2 | 2 | 2 | 2 | 2 | 2 | 2 | 2 |
| ANTIOXIDANT (II) | 1 | 1 | 1 | 1 | 1 | 1 | 1 | 1 | 1 |
| COUPLING AGENT | 2 | 2 | 2 | 2 | 2 | 2 | 2 | 2 | 2 |
| METAL DEACTIVATOR | 1 | 1 | 1 | 1 | 1 | 1 | 1 | 1 | 1 |
| ANTI-TACK AGENT | 1 | 1 | 1 | 1 | 1 | 1 | 1 | 1 | 1 |
| Thickness (mm) | 0.75 | 0.75 | 0.75 | 0.80 | 0.80 | 0.80 | 1.35 | 1.35 | 1.35 |
| Second Insulating Layer | | | | | | | | | |
| Material | N11 | N11 | N11 | N11 | N11 | N11 | N11 | N11 | N11 |
| Thickness (mm) | 0.10 | 0.10 | 0.10 | 0.10 | 0.10 | 0.10 | 0.127 | 0.127 | 0.127 |
| Layer Thickness Ratio | 1:0.13 | 1:0.13 | 1:0.13 | 1:0.13 | 1:0.13 | 1:0.13 | 1:0.09 | 1:0.09 | 1:0.09 |
| Properties | | | | | | | | | |
| Char Height (m) | 1.1 | 1.0 | 1.0 | 0.30 | 0.56 | 0.66 | 0.46 | 0.38 | 0.36 |
| Melt Height (m) | 1.8 | 1.8 | 1.8 | 0.64 | 0.79 | 0.86 | 0.58 | 0.56 | 0.53 |
| Flame Propagation | P | P | P | P | P | P | P | P | P |

[3]tin plated copper wire

As shown in Table 3, the insulated wires of the present invention pass the ANSI/IEEE Standard 383-1974 Flame Test of Class 1E Electric Cables, in that these insulated wires did not propagate fire even when the insulation had been destroyed in the area of flame impingement. As such, the insulated wires of the present invention are qualified for use outside of fire-proof or flame-resistant electrical cabinets.

Although this invention has been shown and described with respect to detailed embodiments thereof, it will be understood by those skilled in the art that various changes in form and detail thereof may be made without departing from the spirit of the claimed invention.

What is claimed is:

1. A dual layer insulation system, which comprises:

a) a first insulating layer having a thickness of at least about 0.6 millimeters and comprising a cross-linked, highly flame-retardant and halogen-free resin composition, wherein said resin composition comprises: 100 parts by weight of a thermoplastic resin; from about 100 to about 250 parts by weight of at least one flame-retarding agent; and from about 1 to about 10 parts by weight of an organosilicon compound represented by the formula:

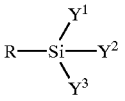

wherein R represents an alkyl group containing an acrylic or methacrylic group and wherein $Y^1$, $Y^2$, and $Y^3$ each represents a group selected from an alkyl group, an alkoxyl group, and mixtures thereof; and b) a second insulating layer having a thickness and comprising a thermoplastic material selected from alloys of polyolefins and polyamides, polyamides, polyamide/polyether block copolymers, polyesters, polyethylenes, polyurethanes and mixtures thereof, wherein the thickness of said second insulating layer is at least 4 percent of said thickness of the first insulating layer.

2. The dual layer insulation system of claim 1, wherein said first insulating layer demonstrates a Limiting Oxygen Index of at least 30.

3. The dual layer insulation system of claim 1, wherein said thermoplastic resin of said first insulating layer is selected from polyethylenes, ethylene-α-olefin copolymers, ethylene-propylene thermoplastic elastomers, ethylene-vinylacetate copolymers, ethylene-ethylacrylate copolymers, ethylene-methylmethacrylate copolymers, ethylene-methacrylic acid copolymers, ethylene-methylacrylate copolymers and mixtures thereof.

4. The dual layer insulation system of claim 3, wherein said thermoplastic resin is an ethylene-vinylacetate copolymer having a melt index of from about 0.5 to about 5 and a vinylacetate content of from about 28 to about 45% by weight.

5. The dual layer insulation system of claim 3, wherein said thermoplastic resin is an ethylene-ethylacrylate copolymer having a melt index of from about 0.5 to about 5 and an ethylacrylate content of from about 9 to about 25% by weight.

6. The dual layer insulation system of claim 1, wherein said flame-retarding agent is selected from aluminum trihydrate, clay, magnesium carbonate, metal hydroxides, talc and mixtures thereof.

7. The dual layer insulation system of claim 6, wherein said flame-retarding agent is magnesium hydroxide.

8. The dual layer insulation system of claim 1, wherein said organosilicon compound is selected from γ-methacryloxypropyltrimethoxysilane, γ-methacryloxypropyltriethoxysilane, γ-acryloxypropyltrimethoxysilane, γ-methacryloxypropyldimethoxymethylsilane, γ-methacryloxypropyldimethylchorosilane and mixtures thereof.

9. The dual layer insulation system of claim 8, wherein said organosilicon compound is γ-methacryloxypropyltrimethoxysilane.

10. The dual layer insulation system of claim 1, wherein said first insulating layer has a thickness ranging from about 0.6 to about 0.75 millimeters.

11. The dual layer insulation system of claim 1, wherein said thermoplastic material of said second insulating layer has a flexural modulus (ASTM D-790) of less than 20,000 kilograms per square centimeter.

12. The dual layer insulation system of claim 11, wherein said thermoplastic material is a polyamide.

13. The dual layer insulation system of claim 12, wherein said polyamide is polyamide 11.

14. The dual layer insulation system of claim 12, wherein said polyamide is flame-retarded polyamide 11.

15. The dual layer insulation system of claim 1, where said second insulating layer has a thickness ranging from about 0.025 to about 0.13 millimeters.

16. The dual layer insulation system of claim 1, wherein said thermoplastic material of said second insulating layer is a polyamide and wherein the ratio of the thickness of the first insulating layer and the thickness of the second insulating layer ranges from about 1:0.04 to less than 1:0.22.

17. The dual layer insulation system of claim 1, wherein said thermoplastic material of said second insulating layer is an alloy of a polyolefin and a polyamide and wherein the ratio of the thickness of the first insulating layer and the thickness of the second insulating layer ranges from about 1:0.04 to less than 1:0.22.

18. The dual layer insulation system of claim 1, wherein said thermoplastic material of said second insulating layer is polyester and wherein the ratio of the thickness of the first insulating layer and the thickness of the second insulating layer ranges from about 1:0.04 to less than 1:0.29.

19. The dual layer insulation system of claim 1, wherein said thermoplastic material of said second insulating layer is a polyamide/polyether block copolymer and wherein the ratio of the thickness of the first insulating layer and the thickness of the second insulating layer ranges from about 1:0.04 to less than 1:0.29.

20. The dual layer insulation system of claim 1, wherein said thermoplastic material of said second insulating layer is polyethylene and wherein the ratio of the thickness of the first insulating layer and the thickness of the second insulating layer ranges from about 1:0.04 to less than 1:0.29.

21. The dual layer insulation system of claim 1, wherein said thermoplastic material of said second insulating layer is polyurethane and wherein the ratio of the thickness of the first insulating layer and the thickness of the second insulating layer ranges from about 1:0.04 to less than 1:0.36.

22. A dual layer insulation system, which comprises:

a) a first insulating layer having a thickness of at least about 0.6 millimeters and comprising a cross-linked, highly flame-retardant and halogen-free resin composition, wherein said resin composition comprises: 100 parts by weight of a thermoplastic resin; from about 150 to about 200 parts by weight of magnesium hydroxide; and from about 2 to about 5 parts by weight of an organosilicon compound represented by the formula:

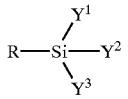

wherein R represents an alkyl group containing an acrylic or methacrylic group and wherein $Y^1$, $Y^2$, and $Y^3$ each represents a group selected from an alkyl group, an alkoxyl group, and mixtures thereof; and b) a second insulating layer having a thickness and comprising flame retarded polyamide 11, wherein the thickness of said second insulating layer is at least 4 percent of the thickness of said first insulating layer.

23. The dual layer insulation system of claim 22, wherein said thermoplastic resin of said first insulating layer is selected from ethylene-vinylacetate copolymers and ethylene-ethylacrylate copolymers.

24. The dual layer insulation system of claim 22, wherein said organosilicon compound of said first insulating layer is selected from γ-methacryloxypropyltrimethoxysilane and γ-methacryloxypropyldimethoxymethylsilane.

25. An insulated conductor, comprising:

a) a conductor having an outer surface;

b) a first insulating layer provided directly on said outer surface of said conductor, wherein said first insulating layer has a thickness of at least about 0.6 millimeters and comprises a cross-linked, highly flame-retardant and halogen-free resin composition, wherein said resin composition comprises: 100 parts by weight of a thermoplastic resin; from about 100 to about 250 parts by weight of at least one flame-retarding agent; and from about 1 to about 10 parts by weight of an organosilicon compound represented by the formula:

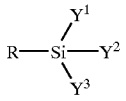

wherein R represents an alkyl group containing an acrylic or methacrylic group and wherein $Y^1$, $Y^2$, and $Y^3$ each represents a group selected from an alkyl group, an alkoxyl group, and mixtures thereof; and c) a second insulating layer having a thickness and comprising a thermoplastic material selected from alloys of polyolefins and polyamides, polyamides, polyamide/polyether block copolymers, polyesters, polyethylenes, polyurethanes and mixtures thereof, wherein the thickness of said second insulating layer is at least 4 percent of the thickness of said first insulating layer.

26. The insulated conductor of claim 25, wherein said insulated wire passes the Underwriters Laboratory VW-1 Vertical Flame Test and demonstrates a cut-through resistance ranging: from about 30 to about 80 pounds, at 23° C., from about 20 to about 60 pounds, at 60° C., and from about 10 to about 40 pounds, at 90° C.

27. The insulated conductor of claim 25, wherein said thermoplastic material of said second insulating layer is flame-retarded polyamide 11 and wherein said insulated wire demonstrates a cut-through resistance ranging: from about 20 to about 60 pounds, at 60° C.; and from about 15 to about 45 pounds, at 90° C.

28. An insulated conductor comprising a plurality of bunched, twisted or bundled wires, wherein said wires are coated with a dual layer insulation system, which comprises:

a) a first insulating layer having a thickness of at least about 0.6 millimeters and comprising a cross-linked, highly flame-retardant and halogen-free resin composition, wherein said resin composition comprises: 100 parts by weight of a thermoplastic resin; from about 100 to about 250 parts by weight of at least one flame-retarding agent; and from about 1 to about 10 parts by weight of an organosilicon compound represented by the formula:

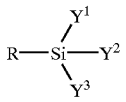

wherein R represents an alkyl group containing an acrylic or methacrylic group and wherein $Y^1$, $Y^2$, and $Y^3$ each represents a group selected from an alkyl group, an alkoxyl group, and mixtures thereof and b) a second insulating layer having a thickness and comprising a thermoplastic material selected from alloys of polyolefins and polyamides, polyamides, polyamide/polyether block copolymers, polyesters, polyethylenes, polyurethanes and mixtures thereof, wherein the thickness of said second insulating layer is at least 4 percent of the thickness of said first insulating layer.

29. The insulated conductor of claim 28, wherein each said wire is coated with said first insulating layer and wherein said plurality of bunched, twisted or bundled wires is coated with said second insulating layer.

30. The insulated conductor of claim 28, wherein said wires are each coated with said dual layer insulation system.

31. A dual layer insulation system, which comprises:

a) a first insulating layer having a thickness of at least about 0.6 millimeters and comprising a cross-linked, highly flame-retardant and halogen-free resin composition, wherein said resin composition comprises: 100 parts by weight of a thermoplastic resin; from about 100 to about 250 parts by weight of at least one flame-retarding agent; and from about 1 to about 10 parts by weight of an organosilicon compound represented by the formula:

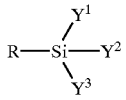

wherein R represents an alkyl group containing an acrylic or methacrylic group and wherein $Y^1$, $Y^2$, and $Y^3$ each represents a group selected from an alkyl group, an alkoxyl group, and mixtures thereof; and b) a second insulating layer having a thickness and comprising a thermoplastic material selected from alloys of polyolefins and polyamides, polyamides, polyamide/polyether block copolymers, polyesters, polyethylenes, polyurethanes and mixtures thereof, wherein the thickness of said second insulating layer is at least 4 percent of the thickness of said first insulating layer, and wherein said first and second insulating layers are solidified by cooling said layers.

32. A process for preparing an insulated conductor comprising a conductor and at least two tightly-adhered, extruded, insulating layers provided thereon, wherein said process comprises: increasing the force under which molten material used to prepare an outer insulating layer is applied to an inner insulating layer provided on said conductor by constricting the flow of said molten material.

33. A process for preparing an insulated conductor comprising a conductor and at least two tightly-adhered, extruded, insulating layers provided thereon, wherein said process comprises: increasing the period of time in which said extruded, insulating layers are in contact prior to solidification by cooling said layers via ambient air cooling.

* * * * *